US006947031B2

(12) United States Patent
Sandbach et al.

(10) Patent No.: US 6,947,031 B2
(45) Date of Patent: Sep. 20, 2005

(54) DATA PROCESSING APPARATUS WITH REPLACEMENT KEYBOARD

(75) Inventors: David Lee Sandbach, London (GB); Christopher Chapman, Oxon (GB)

(73) Assignee: Electrotextiles Company Limited, Hertfordshire (GB)

( * ) Notice: Subject to any disclaimer, the term of this patent is extended or adjusted under 35 U.S.C. 154(b) by 305 days.

(21) Appl. No.: 09/980,172

(22) PCT Filed: Mar. 30, 2001

(86) PCT No.: PCT/GB01/01429

§ 371 (c)(1),
(2), (4) Date: Nov. 29, 2001

(87) PCT Pub. No.: WO01/75575

PCT Pub. Date: Oct. 11, 2001

(65) Prior Publication Data

US 2003/0011576 A1 Jan. 16, 2003

(30) Foreign Application Priority Data

Mar. 30, 2000 (GB) ..... 0007679

(51) Int. Cl.[7] ..... G09G 5/00; H03M 11/00; G06F 13/38

(52) U.S. Cl. ..... 345/168; 345/172; 341/24; 710/67

(58) Field of Search ..... 345/156, 168–169, 345/172, 157, 173, 179; 341/22, 24, 25; 710/67; 714/813; 400/50–52; 361/680

(56) References Cited

U.S. PATENT DOCUMENTS

| | | | | |
|---|---|---|---|---|
| 3,911,215 A | | 10/1975 | Hurst et al. | |
| 3,932,838 A | * | 1/1976 | Sitter | 714/813 |
| 3,932,866 A | * | 1/1976 | Sasaki | 341/24 |
| 4,220,815 A | | 9/1980 | Gibson et al. | |
| 4,381,502 A | * | 4/1983 | Prame | 341/26 |
| 4,687,885 A | | 8/1987 | Talmage, Jr. et al. | |
| 4,707,845 A | | 11/1987 | Krein et al. | |
| 4,798,919 A | | 1/1989 | Miessler et al. | |
| 5,053,585 A | * | 10/1991 | Yaniger | 178/18.05 |
| 5,159,159 A | | 10/1992 | Asher | |

(Continued)

FOREIGN PATENT DOCUMENTS

| | | |
|---|---|---|
| EP | 0261770 A2 | 3/1988 |
| EP | 0343808 A2 | 11/1989 |
| EP | 0989509 A2 | 3/2000 |
| GB | 2132359 A | 7/1984 |
| GB | 2350431 A | 11/2000 |
| GB | 2350683 A | 12/2000 |
| JP | 04100139 | 4/1992 |
| JP | 8137604 A | 11/1994 |
| JP | 10254607 A | 3/1997 |

*Primary Examiner*—Regina Liang
*Assistant Examiner*—Duc Q Dinh
(74) *Attorney, Agent, or Firm*—Harness, Dickey & Pierce, PLC

(57) ABSTRACT

Data processing apparatus (101 and 102) configured to receive signals from an input sensor (106) arranged to duplicate or replace operations of a keyboard, in which the signals correspond to positions of mechanical interactions with the sensor (106). The apparatus comprises processing means (1202) configured to process data derived from the input sensor including positional data corresponding to the position of a mechanical interaction with said input sensor (106) and a second data type corresponding to the absence of a mechanical interaction with said input sensor. The processing means (1202) is configured to generate data representing a first character in response to processing an item of data of said second type followed by positional data corresponding to a first position, and to generate data representing a different second character in response to processing positional data corresponding to a different second position followed by an item of data of said second type.

20 Claims, 15 Drawing Sheets

U.S. PATENT DOCUMENTS 5,262,778 A 11/1993 Saunders
5,453,941 A 9/1995 Yoshikawa
5,686,705 A 11/1997 Conroy et al.
5,815,139 A 9/1998 Yoshikawa et al.
5,852,260 A 12/1998 Yoshikawa
5,907,375 A 5/1999 Nishikawa et al.
6,100,875 A * 8/2000 Goodman et al. ..... 345/163
6,426,868 B1 * 7/2002 Fullerton ..... 361/680
6,532,003 B2 * 3/2003 Nagao ..... 345/168
6,727,829 B2 * 4/2004 Jam ..... 341/20

* cited by examiner

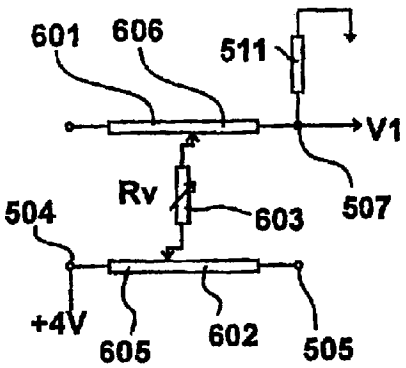
Figure 6A
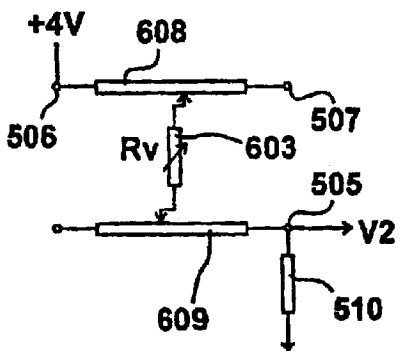
Figure 6B
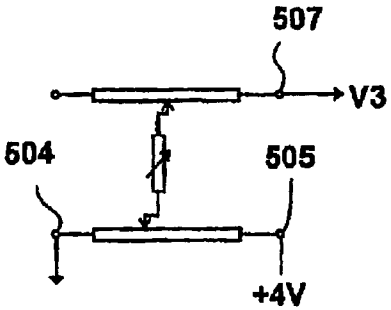
Figure 6C
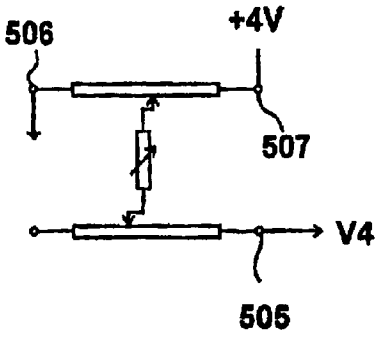
Figure 6D
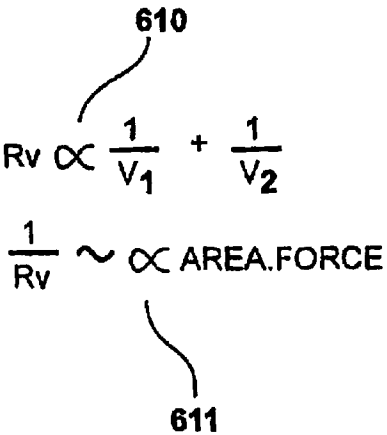

| PIN NO | CONFIGURATION |
|---|---|
| 18 | HIGH IMPEDANCE INPUT - INTERNALLY CONNECTED TO A TO D CONVERTER |
| 17 | HIGH IMPEDANCE INPUT - INTERNALLY CONNECTED TO A TO D CONVERTER |
| 1 | HIGH IMPEDANCE INPUT |
| 2 | HIGH IMPEDANCE INPUT |
| 10 | HIGH IMPEDANCE INPUT |
| 11 | HIGH IMPEDANCE INPUT |
| 12 | HIGH IMPEDANCE INPUT |
| 13 | HIGH IMPEDANCE INPUT |
| 7 | LOW IMPEDANCE OUTPUT |

DATA PROCESSING APPARATUS WITH REPLACEMENT KEYBOARD

The present invention relates to a data processing apparatus configured to receive signals from an input sensor arranged to duplicate or replace operations of a keyboard.

Conventional electronic keyboards comprise of an array of sensors (switches), each corresponding to a particular key. During use, the sensors are interrogated sequentially to determine which are being pressed.

Input sensors arranged to replace operations of a conventional keyboard are known, an example being the touch screen of a hand-held computer, such as a Palm (RTM) Vx, when used in a keyboard mode. In keyboard mode, an array of keys are displayed on the screen, below an area into which typing may be produced. A particular letter, number or symbol may be selected by pressing the screen with a stylus at the correct location. On pressing the screen, the particular key changes colour to indicate that its selection has been recognised by the computer, and on releasing the pressure, the selected letter is added to the typing on screen.

A disadvantage of this type of system, is that the computer is only able to accurately recognise individual "key-presses". If two keys are pressed such that the second is pressed before the first is released, neither of the pressed keys are interpreted by the computer as having been pressed. In circumstances where over-lapping key-presses can take place, for instance where the touch screen is large enough to accept finger presses from more than one digit, this limitation tends to provide for slow input of data compared to a conventional keyboard system.

According to a first aspect of the present invention there is provided data processing apparatus configured to receive signals from an input sensor arranged to duplicate or replace operations of a keyboard, said signals corresponding to positions of mechanical interactions with said sensor, said apparatus comprising: processing means configured to process data derived from said input sensor including positional data corresponding to the position of a mechanical interaction with said input sensor and a second data type corresponding to the absence of a mechanical interaction with said input sensor, wherein said processing means is configured to generate data representing a first character in response to processing an item of data of said second type followed by positional data corresponding to a first position, and to generate data representing a different second character in response to processing positional data corresponding to a different second position followed by an item of data of said second type.

Preferably said sensor is an XY position sensor, and said positional data corresponds to the position within a continuous area defined by said sensor. For the purposes of this specification, an XY position sensor is defined to be a sensor which is capable of providing two electrical values that each relate to the two dimensional position of a mechanical interaction on the surface of the sensor.

The processing means may comprise a single processing device. However, in a preferred embodiment, said processing means comprises two processing devices, such that: one of said processing devices is configured to receive said signals from said input sensor and to generate said positional data and data of said second data type; and the second of said processing devices is configured to process said positional data and data of said second data type to generate data corresponding to displayable characters. Preferably, the first processing device is configured to generate a stream of data comprising positional data, and to send positional data to said second processing device only when an item of positional data differs from the immediately preceding item of sent data by more than a predetermined amount.

According to a second aspect of the present invention there is provided a method of processing signals received from an input sensor arranged to replace operations of a keyboard, said signals corresponding to positions of mechanical interactions with said sensor, wherein said method comprises: processing data derived from said signals, said data comprising positional data corresponding to the position of a mechanical interaction with said input sensor and a second data type corresponding to the absence of a mechanical interaction with said input sensor, such that data representing a first character is generated in response to processing an item of data of said second type followed by positional data corresponding to a first position, and data representing a different second character is generated in response to processing positional data corresponding to a different second position followed by an item of data of said second type.

The invention will now be described by way of example only, with reference to the accompanying drawings in which:

FIGS. 6A, 6B, 6C and 6D illustrate an overview of the measurements made by interface circuit 501;

FIG. 1

Figure 1:
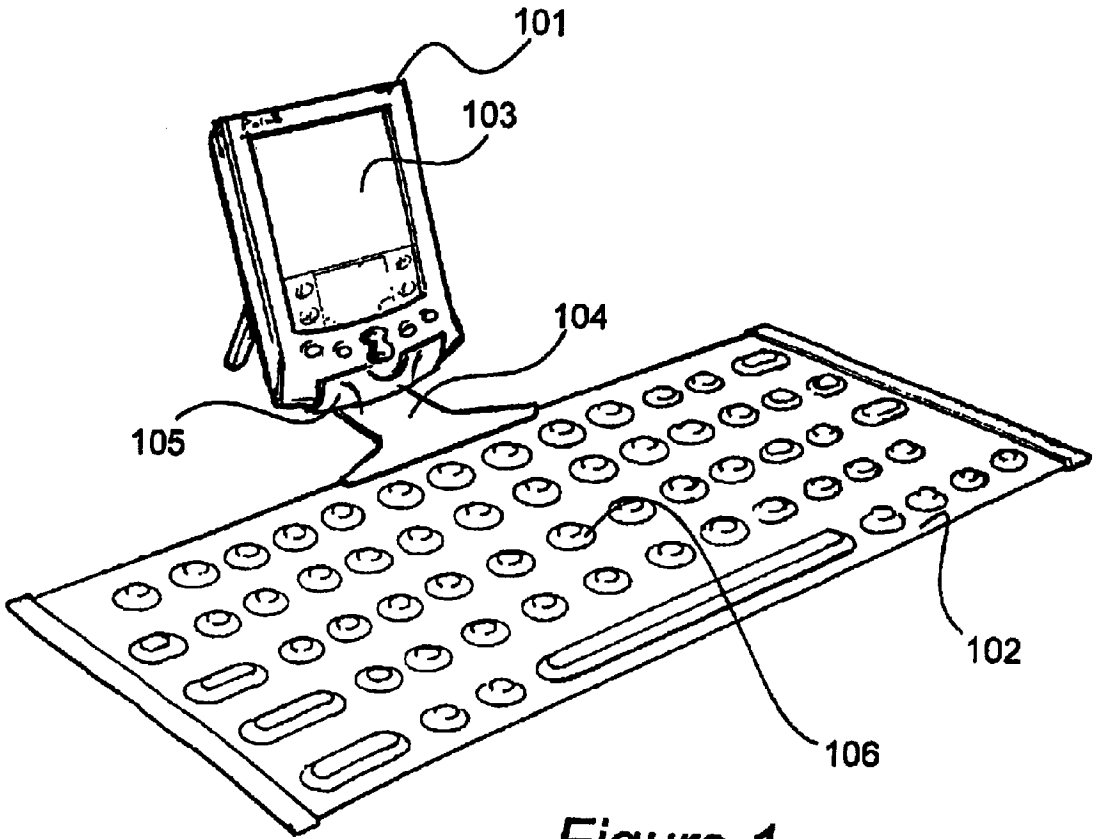
FIG. 1 shows hand held computer 101 and attached manually operable keyboard 102 embodying the present invention.

A hand held computer 101 and attached manually operable keyboard 102, embodying the present invention are shown in FIG. 1. The computer 101 is a Palm (RTM) Vx with a touch sensitive LCD display. In some modes of operation, the computer 101 displays a keyboard on its LCD display 103 and keys may be selected by manual operation of a stylus upon the screen 103. The purpose of the keyboard 102 is to effectively replace this displayed keyboard, thereby allowing an operator to make use of the keyboard by direct application of their fingers, in a similar manner to the operation of a standard keyboard. In this way, the entry of alpha-numeric data can take place much more quickly, in a way which is generally more familiar to operators and users.

The keyboard comprises an XY position sensor 106 manufactured from a number of layers of material, such that two conducting layers are separated by non-conducting layers. The non-conducting layers are configured to allow said conducting layers to become electrically connected at a the location of a key, when that key is pressed. The keyboard also includes a flexible cable 104 which physically and electrically connects the conducting layers of the sensor 106 to a computer receiving assembly 105. The computer receiving assembly 105 contains an interface circuit and a connector configured to connect with the connector located at the lower rear of the computer 101. Thus, connections on the receiving assembly 105 make electrical connection with the serial port of the computer 101, along with its ground and power supply terminals. The computer 101 supplies approximately four volts to the interface circuit when its batteries are fully charged but this may drop to approximately 3.7 volts as the batteries become low on charge. For the purposes of this description it will be assumed that the interface circuit receives four volts from the computer 101.

In an alterative embodiment, the interface circuit is powered by batteries located within the computer receiving assembly 105.

Before using the keyboard 102, keyboard application software is firstly downloaded to the computer 101 Thus, in a conventional manner, the Palm, with the keyboard detached, is placed in its Hotsync cradle which is connected by its cable to a personal computer (PC) or other computer suitable for the process. The keyboard application software, which may be resident for example on a disc in the floppy disc drive or CD-ROM drive of the PC, is selected by the user for installation, and then transferred to the computer 101 by a Hotsync process.

During operation of the keyboard, the interface circuitry applies voltages across a first conducting layer within the keyboard 101 and when a user presses an individual key, the interface circuitry measures voltages appearing on a second conducting layer to determine an X co-ordinate of the key being pressed. It then applies a voltage across the second conducting layer and measures voltages appearing on the first conducting layer to determine an Y co-ordinate. Having detected the X and Y location of the pressed key, the interface circuitry supplies data to the computer 101 relating to said X and Y location. With the keyboard application installed and running, the computer 101 is able to receive the X and Y location data and generate a character corresponding to the pressed key. Thus, when the "G" key is pressed a "G" or "g" appears on the display 103.

Unlike previous arrangements, in which the keyboard comprises an X and Y location sensor, the computer and keyboard arrangement of FIG. 1 is able to receive and interpret two key-presses that overlap in time. i.e. when a second key is pressed before a first key is released, this arrangement recognises both the first and second key-presses. Such overlapping key-presses are likely to occur when a user types quickly. In fact, because such overlapping key-presses are acceptable to the system of FIG. 1, the user is able to accurately type more quickly than they otherwise could.

FIG. 2

Figure 2:
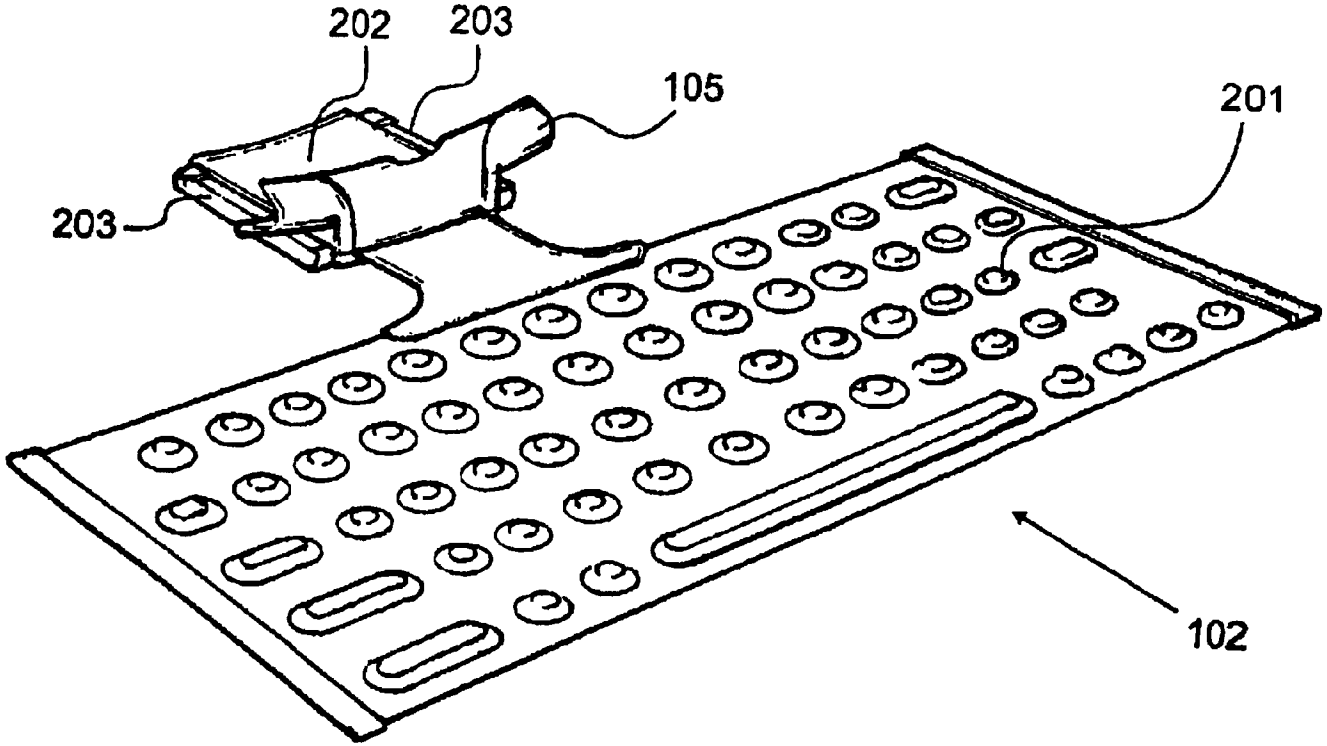
FIG. 2 shows the keyboard 102 of FIG. 1 disconnected.

The keyboard 102 of FIG. 1 is shown disconnected in FIG. 2. The keyboard 102 is constructed from nine layers of textile fabric and a layer containing key registration devices. This construction has been found to be durable, and electrically sound, while providing the flexibility associated with textile fabrics. The key registration devices cause the upper surface of the keyboard to protrude at locations, such as location 201, corresponding to the keys. The keys correspond to letters, numerals and functions found on conventional alpha-numeric keyboards. The key registration devices are over-centre silicone number mouldings which deform when pressed and cause the conducting layers of fabric in the sensor 106 to come into electrical contact at their location.

The computer receiving assembly 105 is configured to engage the lower edge of the computer 101, in the vicinity of the computer's electrical connector, to secure the computer 101 in position. A portion 202 of the receiving assembly 105, which supports the rear surface of the computer 101 during use, houses the interface circuit. A pair of legs 203 are pivotally attached to the portion 202 which may be used to support the computer 101 in an upright position during use.

FIG. 3

Figure 3:
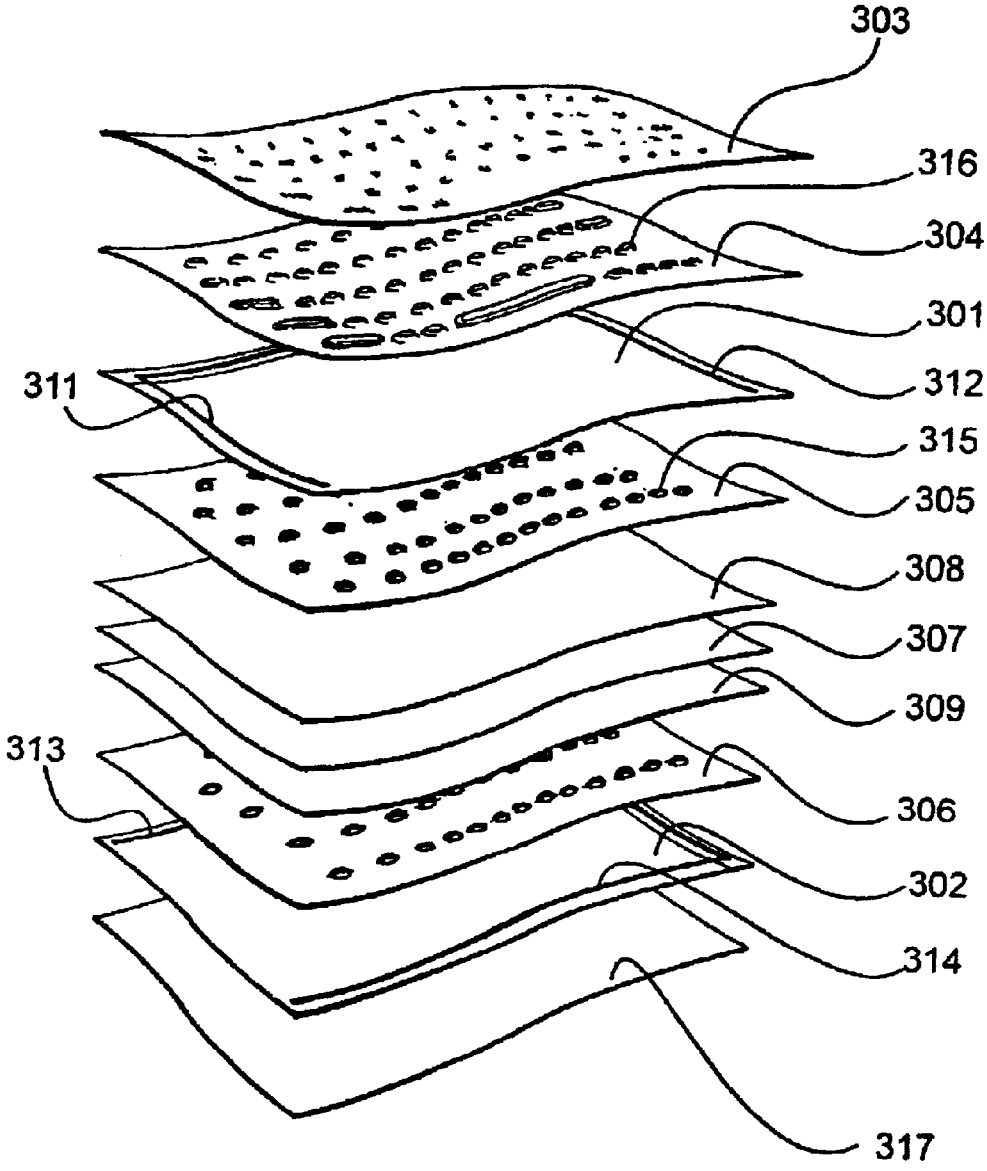
FIG. 3 shows an exploded perspective view of the keyboard of FIG. 2, illustrating its constituent layers.

An exploded perspective view of the keyboard of FIG. 2, illustrating its constituent layers, is shown in FIG. 3 The fabric keyboard 102 comprises ten individual constituent layers, including a first electrically conductive layer 301 and a second electrically conductive layer 302. Both of the electrically conductive fabric layers 301 and 302 have electrically conductive carbon-coated nylon fibres woven or knitted together such that each conductive layer is capable of conducting an electrical current in any direction along the plane of the layer.

The first electrically conductive layer 301 has conductive tracks 311 and 312 forming an electrical contact along the left and the right edges of the fabric keyboard respectively. The conducting tracks may be fabricated from fabric coated with conductive metals, such as silver or nickel. Material of this type is readily available and is used extensively for shielding equipment from electromagnetic interference. The tracks are secured to the conductive layers 301 and 302 using a conductive adhesive.

The tracks 311 and 312 are highly conductive compared to the carbon coated fabric of sheets 301 and 302. Accordingly, a voltage gradient may be applied across the first electrically conductive layer 301 between the right and left edges of the detector (i.e. in an X-axis direction). The second electrically conductive layer 302 has conductive tracks 313 and 314 providing electrical contact along the top and bottom edges of the fabric layer respectively. Accordingly, a voltage may be applied across the second electrically conductive fabric layer 302 in a direction perpendicular to that which a voltage is applied across the first electrically conductive layer 301 (i.e. in the Y-axis direction).

The uppermost layer of the fabric keyboard is a continuous fabric layer 303 which has printed on its upper surface graphical representations corresponding to the alpha numeric keys of the keyboard. The graphical representations are preferably screen printed onto the fabric layer and, during the preferred construction process, the printing of the alpha-numerical graphical representations is performed after the fabric keyboard has been assembled. Furthermore, the fabric layer 303 is preferably made from a stretchable or heat formable fabric so as to enable the fabric to be manipulated to receive the protrusions of the over centre moulding layer 304.

The over centre moulding layer 304 is, in this embodiment, a continuous silicon rubber sheet having key registration device mouldings protruding on its upper surface. The key registration device mouldings protruding from the upper surface layer 304 are specifically moulded so as to align with the alpha numerical graphical representations shown on the uppermost layer 303.

There are five layers located in between the first electrically conductive layer 301 and the second electrically conductive layer 302. A first masking layer 305 and a second masking layer 306 contact the innermost surfaces of the electrically conductive layers 301 and 302 respectively. Both masking layers 305 and 306 are composed of a flexible tear resistant fabric with a laminate coating of polyurethane applied to a surface of the fabric. In an alternative embodiment, masking layers 305 and 306 are sheets of polyurethane alone without any fabric constituent.

A series of circular holes 315 have been punched through the masking layers 305 and 306. Each of these holes is located so as to align with a corresponding key registration device moulding 316 of layer 304. During the use of the keyboard, the masking layers prevent electrical contact occurring between a central conducting layer 307 and either of the outer conducting layers 301 and 302, except at locations which correspond to keys. Therefore, accidental compression of the keyboard at locations between the keys does not affect the operation of the keyboard.

Located in between the masking layers 305 and 306 are insulating mesh layers 308 and 309. The insulating layers 308 and 309 are woven or knitted with a relatively wide spacing between fibres so that the conductive layers are separated while at the same time allowing conduction to take place between the conducting layers when mechanical pressure is applied. The presence of these insulating layers ensures that the overall construction may be folded and flexed or wrapped around objects without causing the two conductive layers to be brought into electrical contact and thereby producing an erroneous contact identification.

Located between the insulating mesh layers 308 and 309 is the central conductive layer 307 which is configured to conduct an electric current from the first electrically conductive fabric layer 301 to the second electrically conductive layer 302 (i.e. in the Z axis direction) whilst substantially preventing lateral current flow along the plane of the sheet (i.e. in the X and Y axis directions).

The central conductive layer 307 is constructed by knitting a polyester yarn of twenty-four decitex filaments having a single conductive filament twisted therein, such that the conductive filament appears relatively randomly in the completed knitted product. In addition, the central conductive layer 307 has a conductance perpendicular to the plane of the device (in the z axis) that increases as it is placed into pressure thereby facilitating increasing conduction between the outer conductive layers during a mechanical interaction, of increasing pressure.

A final fabric layer 317 forms the under surface of the fabric keyboard. This layer is preferably a durable fabric cover configured to provide protection to the inner encapsulated layers of the fabric keyboard. In the preferred embodiment, the under surface of layer 317 is laminated with patches of rubber to provide a high co-efficient of friction between the keyboard and any surface onto which the keyboard is placed.

The ten layers forming the fabric keyboard are mechanically secured together by an adhesive provided around the perimeter edges of the constituent fabric layers.

In alternative constructions to the fabric sensor 106, one of the two masking layers 305 and 306 are absent. In other alternative constructions, one or more of layers 303, 316, 315, 307, 309, 306 and 317 are absent. Therefore, in a very simple construction, a sensor representing a keyboard may be constructed from just the conductive layers 301 and 302, and a separating insulating layer, such as layer 308. However, embodiments containing the second insulating layer 309 and central conducting layer 307 have greater electrical stability during folding.

FIG. 4A

Figure 4A:
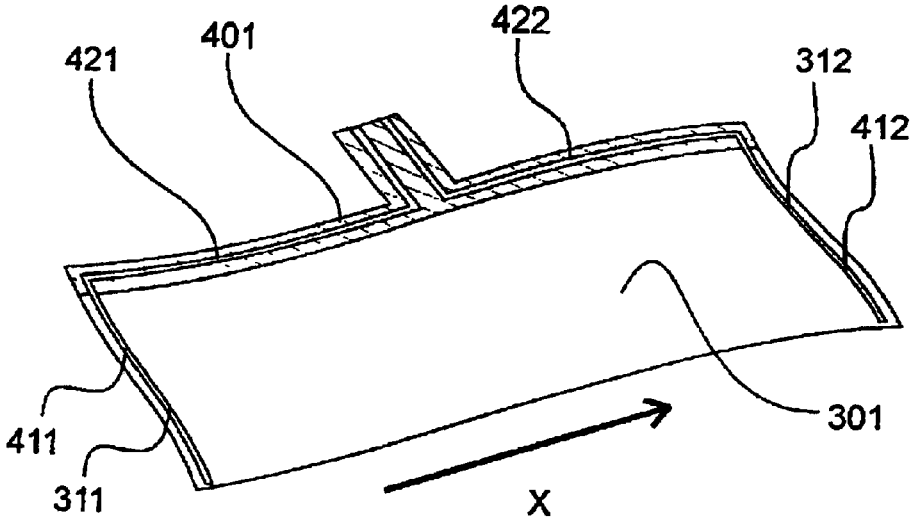
FIGS. 4A and 4B show the electrically conductive fabric layers 301 and 302 of FIG. 3 in more detail.

The first electrically conductive fabric layer 301 is shown in more detail in FIG. 4A. Two conductive tracks 311 and 312 form the electrical contacts with the conductive fibres of fabric layer 301. A contacting portion 411 of conductive track 311 contacts the left edge of fabric layer 301. A conduction portion 421 of conductive track 311 is channeled into the flexible cable 104 and prevented from contacting the electrically conductive fabric layer 301 by insulation strip 401 that runs along the upper edge of fabric layer 301, and shown as a shaded area in FIG. 4A.

Similarly, the conductive track 312 contacts the electrically conductive fabric along the right edge of fabric layer 301 over a contacting portion 412. A conduction portion 422 extends into flexible cable 104 and is prevented from contacting the electrically conductive fabric layer 301 by insulation strip 401 that runs along the upper edge of fabric layer 301. This enables voltages to be applied between the conductive tracks 311 and 312 to provide a voltage gradient in the X axis direction.

FIG. 4B

Figure 4B:
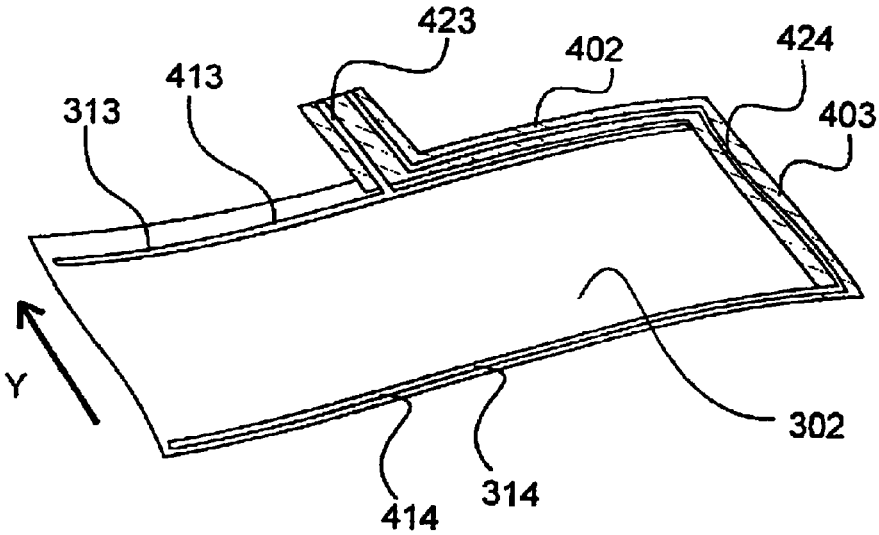

The second electrically conductive layer 302 is shown in more detail in FIG. 4B. Electrical connection is formed with the fabric layer 302 by the two conductive tracks 313 and 314. Conductive track 313 forms an electrical contact with the top edge of the electrically conductive fabric 301 via contacting portion 413. A conduction portion 423 of conductive track 313 extends over insulation strip 402, that extends along the top edge of the fabric layer, and enters the flexible cable 104. Conductive track 314 forms an electrical connection with bottom edge of the fabric sheet 302 via its contacting portion 414. A conduction portion 424 of conductive track 314 extends along the right edge of the fabric sheet and the top edge of the fabric sheet and enters into the flexible fabric cable 104. The conduction portion 424 of conductive track 314 is electrically insulated from the fabric layer by insulating strip 402 which extends along the top edge and 403 which extends along the right edge of layer 302.

Accordingly, voltages may be applied between the conductive tracks 313 and 314 so as to provide a voltage gradient across the electrically conductive fabric layer 302 from top to bottom in the Y axis direction.

In this embodiment, only four connections are possible to the fabric keyboard, two connections to conductive tracks 311 and 312 of fabric layer 301, and two connections to conductive tracks 313 and 314 of fabric layer 302.

FIG. 5

Figure 5:
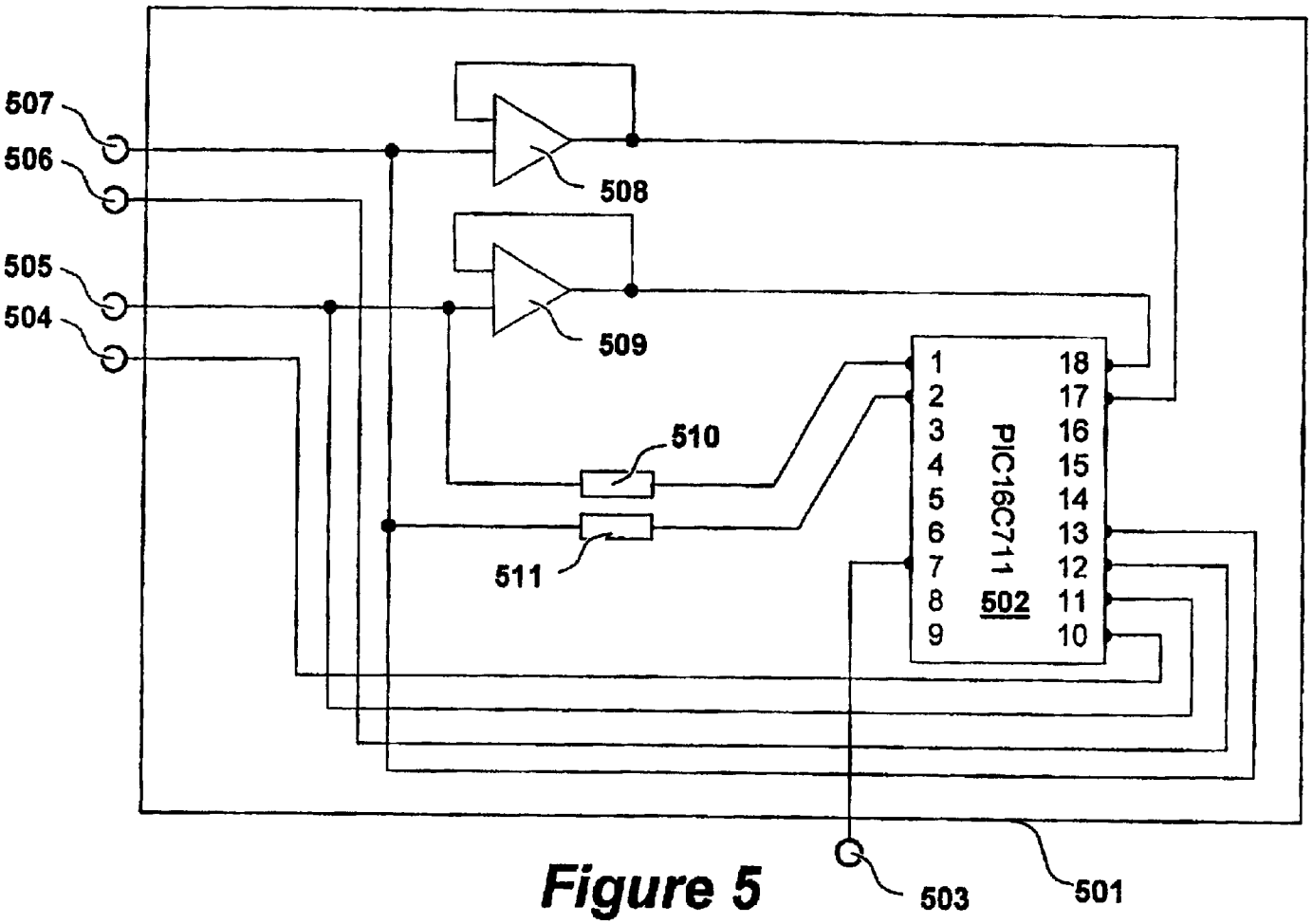
FIG. 5 shows an interface circuit 501, present in the computer receiving assembly 105 of FIG. 1.

The interface circuit 501 located in the computer receiving assembly 105 is detailed in FIG. 5. The interface circuit comprises a peripheral interface controller (PIC) 502 which is connected to a serial communication output 503, for connection to the computer 101, and electrical connections 504, 505, 506 and 507 configured to supply and receive the necessary voltages to the conductive tracks 311, 312, 314 and 313 respectively.

The peripheral interface controller (PIC) 502 is a programmable controller of the type PIC16C711. The PIC 502 operates under the control of a programmed which controls the parameters of the keyboard which the interface circuit 501 is configured to measure. Parameters under investigation will be discussed further in reference to FIGS. 6A to 6D and 7 to 10. Under control of the PIC 502, the necessary output voltages can be supplied to electrical connections 504, 505, 506 and 507 via pins one, two, ten, eleven, twelve and thirteen of the PIC. The PIC includes an analogue to digital converter which is used to process analogue voltages received at pins seventeen and eighteen. The input pins seventeen and eighteen receive outputs from high impedance buffers 508 and 509 respectively. The buffers 508 and 509 are half of unity gain operational amplifiers of the type TL062. The buffers 508 and 509 provide a high impedance buffer between the sensor output voltages received at connections 507 and 505, and the PIC 502 input ports seventeen and eighteen respectively.

Connection to pins one and two occurs via resistors 510 and 511 respectively. Resistors 510 and 511 are selected according to the resistance of the keyboard as measured from a conducting track attached to one fabric layer 301 to a conducting track attached to the second fabric layer 302 while a typical mechanical interaction pressure, i.e. a key-press is applied. A value of ten Kohms is typical for resistors 510 and 511.

The PIC 502 has an external crystal oscillator (not shown) running at four MHz connected across pins fifteen and sixteen. Positive four volts received from the computer 101 is supplied to pin fourteen and ground is connected to pin five. Pin four (the internal reset input) is held at positive four volts via a series resistor of one hundred ohms.

The PIC 502 is programmed to supply and receive the necessary voltages to the conductive tracks 311, 312, 314 and 313 of the conductive layers 301 and 302. By this means the interface circuit is able to determine a measure, denoted by Z, of the pressure applied to the keyboard, and if this value is sufficiently large the interface circuit interprets this as a key-press. When a key-press is detected the interface circuit performs a measurement of the X and Y location of where the pressure is being applied. The PIC is further configured to supply data to the output serial port 503 relating to the position of key-presses detected or the absence of a key-press.

An overview of the measurements made by interface circuit 501 is illustrated by FIGS. 6A, 6B, 6C and 6D. The outer conductive layers 302 and 301 are represented schematically by potentiometers 601 and 602 and the resistance of the conductive path between the outer layers at the location of the applied force is represented by variable resistor 603.

FIG. 6A

A first measurement is shown in FIG. 6A. Four volts are applied to connector 504, while connector 505 remains disconnected. Connector 507 is connected to ground via the resistor 511 of known value. Thus, current flows from connector 504 through a first part of layer 301 indicated by a first part 605 of potentiometer 602, through the conductive path indicated by variable resistor 603 having resistance Rv, through a first part of layer 302, indicated by a first part 606 of potentiometer 601 and through the known resistor 511. The voltage, V1 appearing at connector 507 is measured and since this is equal to the voltage drop across resistor 511, V1 is directly proportional to the current flowing from connector 504.

FIG. 6B

A second measurement is shown in FIG. 6B. Four volts are applied to connector 506, while connector 507 is disconnected. Connector 505 is connected to ground via the resistor 510 of known resistance. The voltage V2, dropped across resistor 510 is measured. Voltage V2 is directly proportional to the current flowing through a second part of layer 302 indicated by a second part 608 of potentiometer 601, through the conductive path indicated by variable resistor 603 having resistance Rv, through a second part of layer 301 indicated by a second part 609 of potentiometer 602 and through resistor 510.

The sum of the resistance of first part 606 and second part 608 of potentiometer 601 is approximately equal to the resistance between contacting portions 413 and 414 on layer 302, and is therefore substantially constant during the measurements, since they occur in rapid succession. Similarly the sum of the resistance of first part 605 and second part 609 of potentiometer 602 is approximately equal to the resistance between contacting portions 311 and 312 on layer 301, and is also substantially constant during the measurements. As a result, the relationship 610 exists between the resistance Rv, of the conductive path between the outer layers, and the measured voltages V1 and V2. i.e. the resistance Rv between the outer layers is proportional to the sum of the reciprocal of voltage V1 and the reciprocal of voltage V2.

In general, depending upon the type of position sensor used, the resistance Rv depends upon area of the applied pressure or a function of the area and the force as illustrated by relationship 611. Thus, from the voltage measurements V1 and V2 a measure which is dependent on the force applied to the keyboard is determined.

FIG. 6C

A third measurement is shown in FIG. 6C. Four volts is applied to connector 505 while connector 504 is grounded, and so a potential gradient is produced across layer 301. A voltage measurement is made at connector 507. Since the interface circuit makes use of the high impedance buffer 508, the voltage appearing on layer 302 at the position of the applied force is determined. This voltage, V3 is directly proportional to the distance of the centre of the applied force from contacting portion 311 and indicates its X axis position.

FIG. 6D

A fourth measurement is shown in FIG. 6D. Four volts are applied to connector 507 and connector 506 is grounded. A voltage measurement is made of voltage V4 appearing at connector 505. Voltage V4 is directly proportional to the distance of the centre of the applied force from contacting portion 414 and indicates its Y axis position. Therefore, voltage V3 and V4 provide information as to the two dimensional position of the applied force on the sensor 106. i.e. voltages V3 and V4 represent X and Y values for the centre of the position of the applied force, representing a key-press.

FIG. 7

Figure 7:
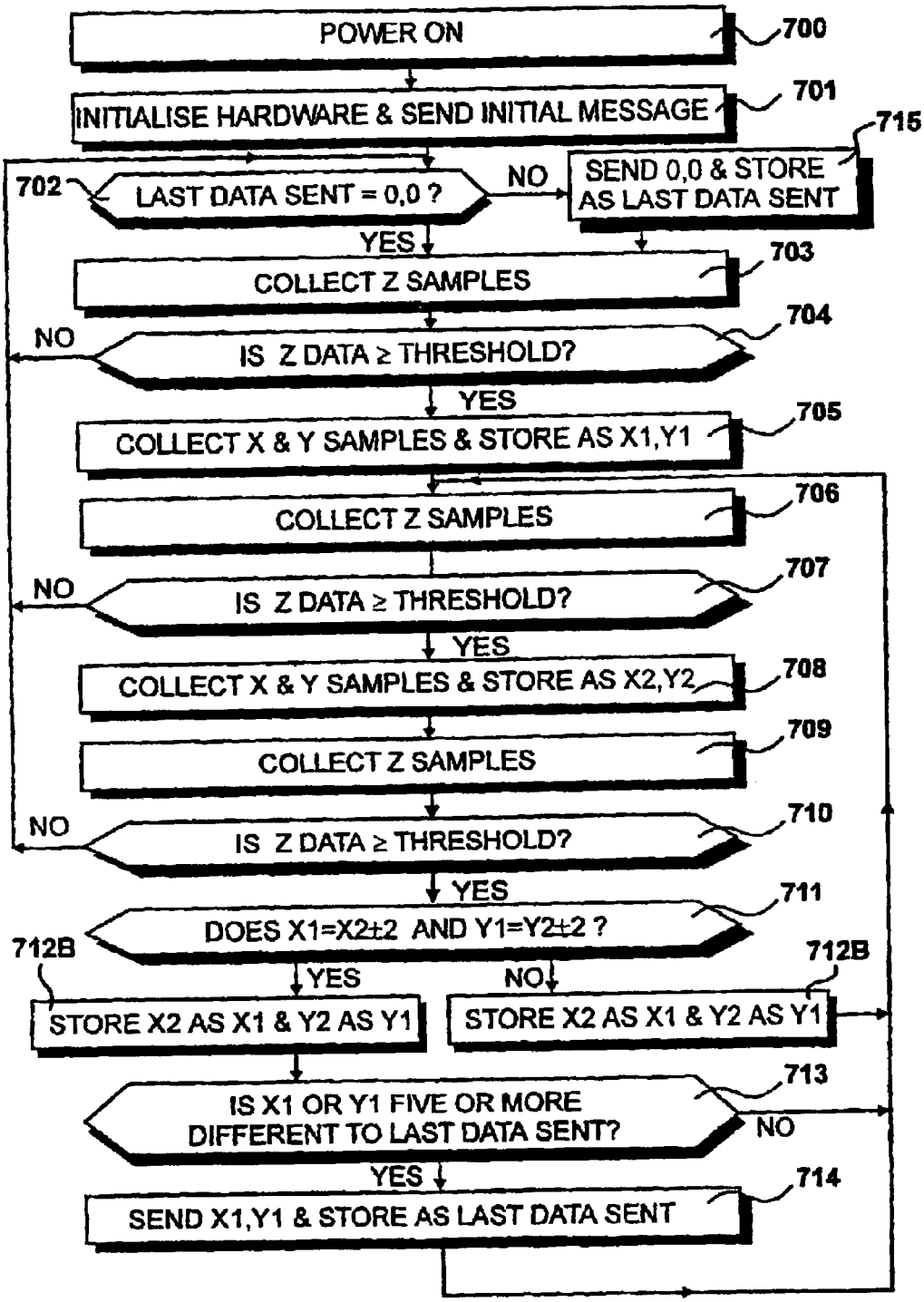
FIG. 7 shows a flow chart of the program running within the peripheral interface circuit of FIG. 5.

The program running within the peripheral interface circuit of FIG. 5 is outlined in the flow chart of FIG. 7. The computer 101 is switched on at step 700 and power is supplied to the interface circuit. At step 701 the hardware is initialised and an initial message is sent to the computer 101 via the serial output port. This process is detailed later with reference to FIG. 18. At step 702 a question is asked as to whether the last data sent to the computer 101 was 0,0, i.e. X=0 and Y=0. During operation of the keyboard, the interface circuit sends positional data to the computer 101 in the form of two eight bit binary numbers, i.e. two numbers of value between zero and 255 (decimal). However, there are no key positions corresponding to 0,0 and the use of these zero values is reserved to indicate to the computer 101 that the keyboard is not being pressed. On the first occasion of entering step 702 the question is answered in the affirmative and so step 703 is entered where a Z value is measured. The Z value is dependent on the force being applied to the keyboard, and so provides an indication as to whether the keyboard is being pressed. At step 704, the measured Z value from step 703 is compared with a predetermined threshold value, and if the measured Z value is equal to or greater than the threshold value, indicating a key-press, step 705 is entered. Alternatively, if the Z value is too small, the process returns to step 702. At step 705, X and Y positional values of the press applied to the keyboard are measured and stored as temporary variables X1 and Y1. At step 706 the Z value is remeasured, by essentially the same process as step 703. At step 707, the Z value from step 706 is compared with the aforementioned threshold value, and as in step 704 if the Z value is less than the threshold value, step 702 is re-entered. But, if the measured Z is greater or equal to the threshold value step 708 is performed. At step 708, X and Y position values are remeasured and stored as X2 and Y2, by a similar process to that at step 705. The Z value is then measured again at step 709, by the same process as at step 703, and compared with the threshold value at step 710. Once again, step 702 is re-entered if the Z value has fallen below the threshold value. If the Z value is still equal to or greater than the threshold, step 711 is entered. Therefore, step 711 is only entered when the interface circuit has measured two consecutive sets of X and Y values such that the Z values measured immediately before and after each set of X and Y values is greater than or equal to a predetermined threshold value. Consequently, the stored X1, Y1 and X2, Y2 values carried forward to step 711, are likely to be the result of intended presses on the keyboard, and they are therefore treated as such by the process.

At step 711 a question is asked as to whether X1 is equal to X2 plus or minus two, and Y1 is equal to Y2 plus or minus two. If the answer to this question is "yes", the measured positional data is regarded as stable and step 712A is entered. Otherwise step 712B is entered where the stored X2 value is stored as X1, and the stored Y2 value is stored as Y1, before the process returns to step 706. Thus, if the positional data is not regarded as stable, as determined by step 711, the process attempts to repeat steps 706 to 710 to acquire a new set of positional X, Y data values.

When the positional data is regarded at step 711 as stable, step 712A is entered which is essentially the same as step 712B in that the stored X2 and Y2 values are stored as X1 and Y1 respectively. However, from step 712A the process enters step 713 where a question is asked as to whether either of the stored X1 or Y1 values differ from the last sent data values by 5 or more. For example, if the last sent data values were 48,174, then at step 713 it is ascertained as to whether X1 is less than 44 or greater than 52, or if Y1 is less than 170 or greater than 178. If the answer to either of the questions is yes then step 714 is entered. Otherwise the process returns to step 706. Therefore, step 714 is only entered if one, or both, of the present positional values is different to the last data sent, and then, at step 714, said present position values, X1 and Y1 are sent to the computer 101 via the output port and stored as the last data sent.

Thus, positional values are only sent when they differ from the previously sent data values by more than a predetermined amount. This means that if a user keeps their finger pressing on a particular key, the PIC only sends data relating to the position of that key once. By this means, the computer's processor is saved from receiving repeated redundant positional data. However, if a first key is pressed and a different second key is pressed before the first is released, this may give rise to two (or more) sets of positional data being sent to the computer consecutively. Typically, during typing, a first key is pressed an instant before a second key and the first to be pressed is also the first to be released. As a result, a moment of stability exists in the period between the two key presses and a second moment of stability exists in the period between the two key releases. Provided these two moments of stability are sufficiently long, the PIC detects the stability in the X and Y values it measures and sends positional data to the computer 101 corresponding to each of the two keys pressed. Between the second key being pressed and the first key being released, the interface circuit receives voltages which imply that positions between the actual two keys are being pressed. It is likely that these positions will be found to be variable one from the next and so regarded as unstable by the PIC at step 711. However, it is possible that during such overlapping key presses, data relating to an intermediate position between the two keys might be sent to the computer 101. It is therefore, a requirement of the further processing performed by the computer 101 to recognise this as only two key presses. This will be explained further with respect to FIG. 13.

As an example, suppose the "G" key is pressed, then a moment later the "L" key is pressed, the "G" key is released and then the "L" key released. The interface circuit measures stable positional values relating to the "G" key and sends corresponding data to the computer 101. It may then measure stable positional values relating to any of the keys positioned between "G" and "L" and send corresponding data, before it measures stable positional values relating to the "L" key and sends data corresponding to its position.

Having sent data at step 714 the process then returns to step 706. In the event that the keyboard is no longer being pressed when the Z value is measured at steps 706 or 709, the question asked at step 707 or 710 will be answered in the negative and the process returned to step 702. At step 702, if the last data sent to the computer 101 was positional data corresponding to a pressed key, the question will be answered negatively and step 715 will be entered. At step 715 the data 0,0 is sent to the computer 101 to indicate the absence of a key-press and 0,0 is stored as the last data sent. Following step 715, step 703 is entered and the process continues as previously described.

In summary of the program running within the PIC, it defines a process in which positions of mechanical interactions, corresponding to key-presses, are measured and where said positions are found to be momentarily stable, positional data relating to those stable positions is sent to the computer 101. However, the data is only sent if it is different to the most recent data sent by a predetermined amount. In addition, in the event that the keyboard stops being pressed, a second data type, in this case the data 0,0, is sent to the computer 101 to indicate the absence of a key-press.

It should now be understood, that when single keys are pressed individually, the data which is sent to the computer 101 is the 0,0 data relating to the absence of a key-press, followed by positional data, followed by 0,0 data as the key is released. Also, when two keys are pressed in the aforementioned overlapping manner, the data which is sent to computer 101 is the 0,0 data, followed by two or more sets of positional data, followed by 0,0 data.

FIG. 8

Figure 8:
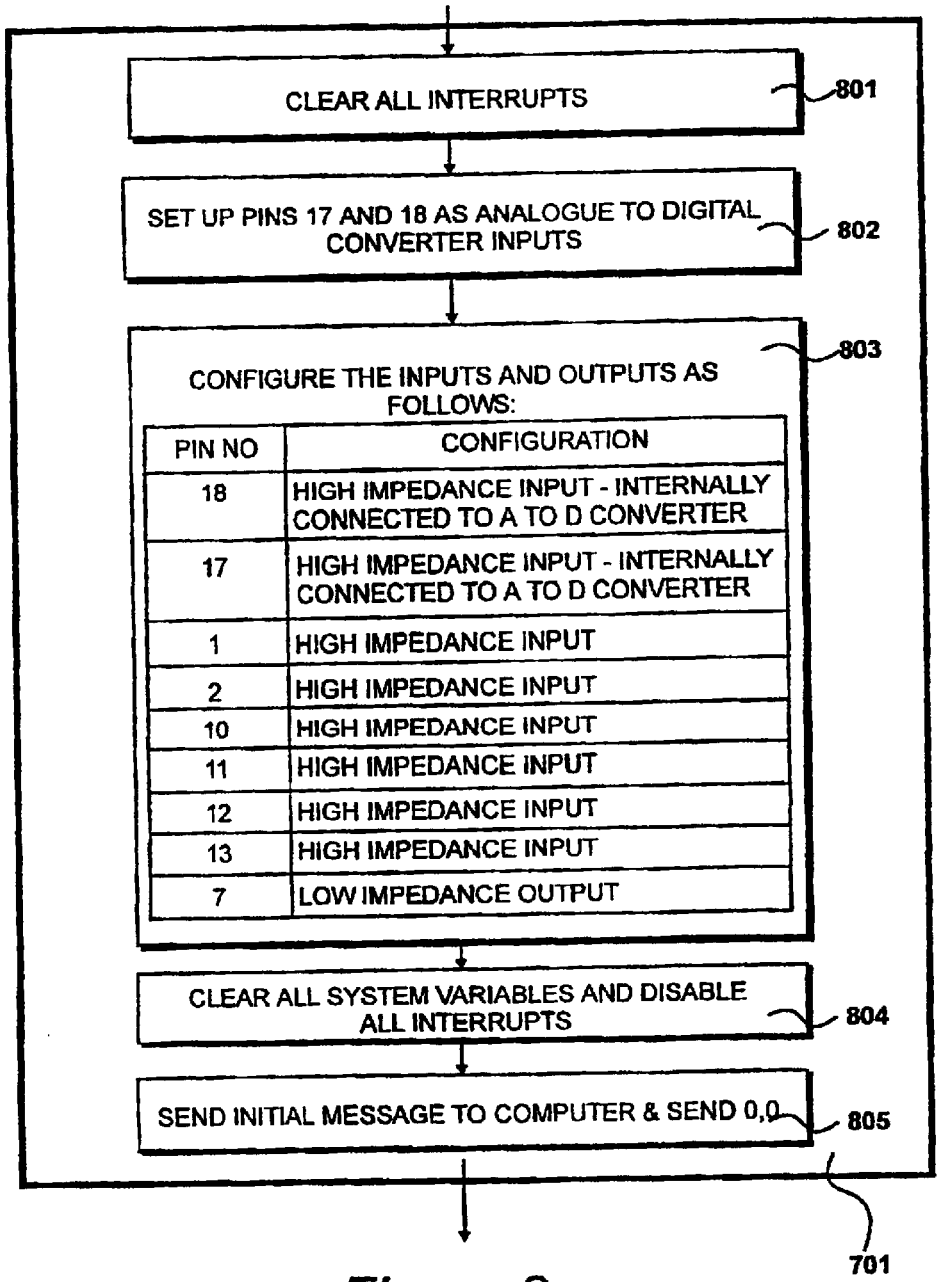
FIG. 8 shows step 701 of FIG. 7 in further detail.

Step 701 of FIG. 7 is shown in further detail in FIG. 8. Within the initialisation step 701, at step 801 the interrupts are cleared and then at step 802 pins seventeen and eighteen of the PIC are set up as analogue to digital converter inputs. The micro ports of a PIC16C711 may be configured as low impedance outputs or high impedance inputs, and when in high impedance input mode, pins seventeen and eighteen can be programmed to connect via an internal multiplexer, to the analogue to digital converter. At step 803 the ports which are to be used as inputs or outputs are configured in their initial state Therefore, pins eighteen, seventeen, one, two, ten, eleven, twelve and thirteen are configured as high impedance inputs while pin seven is configured as a low impedance output. At step 804 all system variables are cleared and all interrupts are disabled. At step 805 an initial message is sent to the computer 101 confirming the presence of the keyboard 102. In response, the computer 101 will then run the keyboard application so that data received from the keyboard is correctly processed. In addition, the data 0,0 is sent to the computer 101 indicating that no keys are presently being pressed on the keyboard.

FIG. 9

Figure 9:
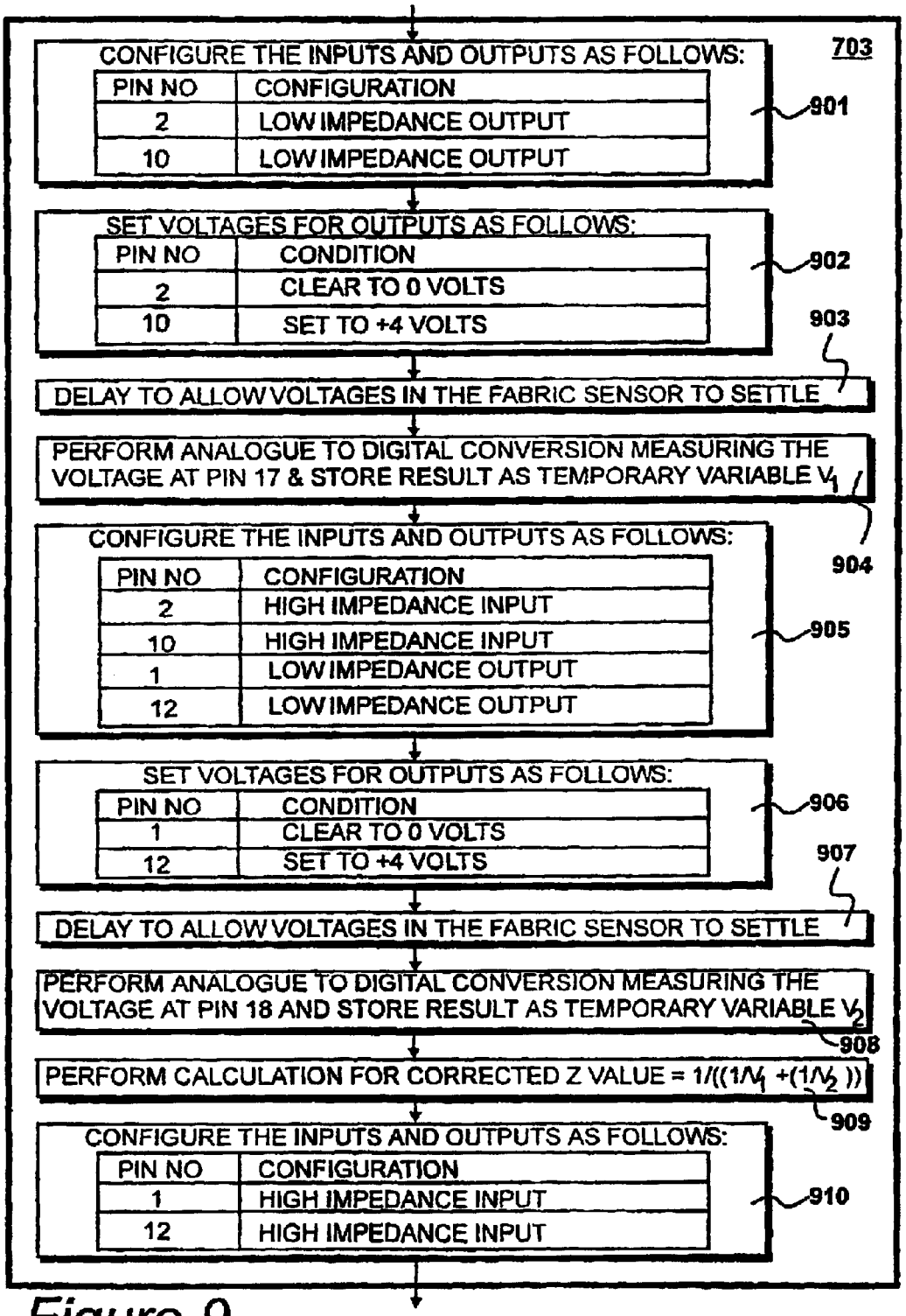
FIG. 9 shows step 703 of FIG. 7 in further detail.

Step 703 of FIG. 7 is shown in further detail in FIG. 9. Within step 703, at step 901, the ports corresponding to pins two and ten are reconfigured as low impedance output ports and at step 902 pin two is set to zero volts while pin ten is set to positive four volts. Thus, connector 507 is grounded via resistor 511 and four volts are applied to connector 504. At step 903 a time delay, (typically of 200 microseconds in a sensor measuring 90 millimetres by 240 millimetres with an outer layer resistance of 3.5 Kohms) is provided to allow voltages to settle before the voltage at pin seventeen is measured and stored. Thus, voltage V1 present at connector 507 is measured and stored as temporary variable V1.

At step 905 pins two and ten are reconfigured as high impedance inputs while pins one and twelve are reconfigured as low impedance outputs. At step 906 the voltages on pins one and twelve are set to zero and positive four volts respectively. Thus, connector 505 is grounded via resistor 510 while four volts are supplied to connector 506. A suitable time delay, equivalent to that at step 903, is provided at step 907 before the voltage at pin eighteen is measured and stored at step 908. Thus, the voltage present on connector 505 is measured and stored as temporary variable V2. At step 909, a Z value is calculated from stored voltages V1 and V2, as $1/((1/V1)+(1/V2))$ and it is then stored. The pins one and twelve are reconfigured back to their initial state of high impedance inputs at step 910.

FIG. 10

Figure 10:
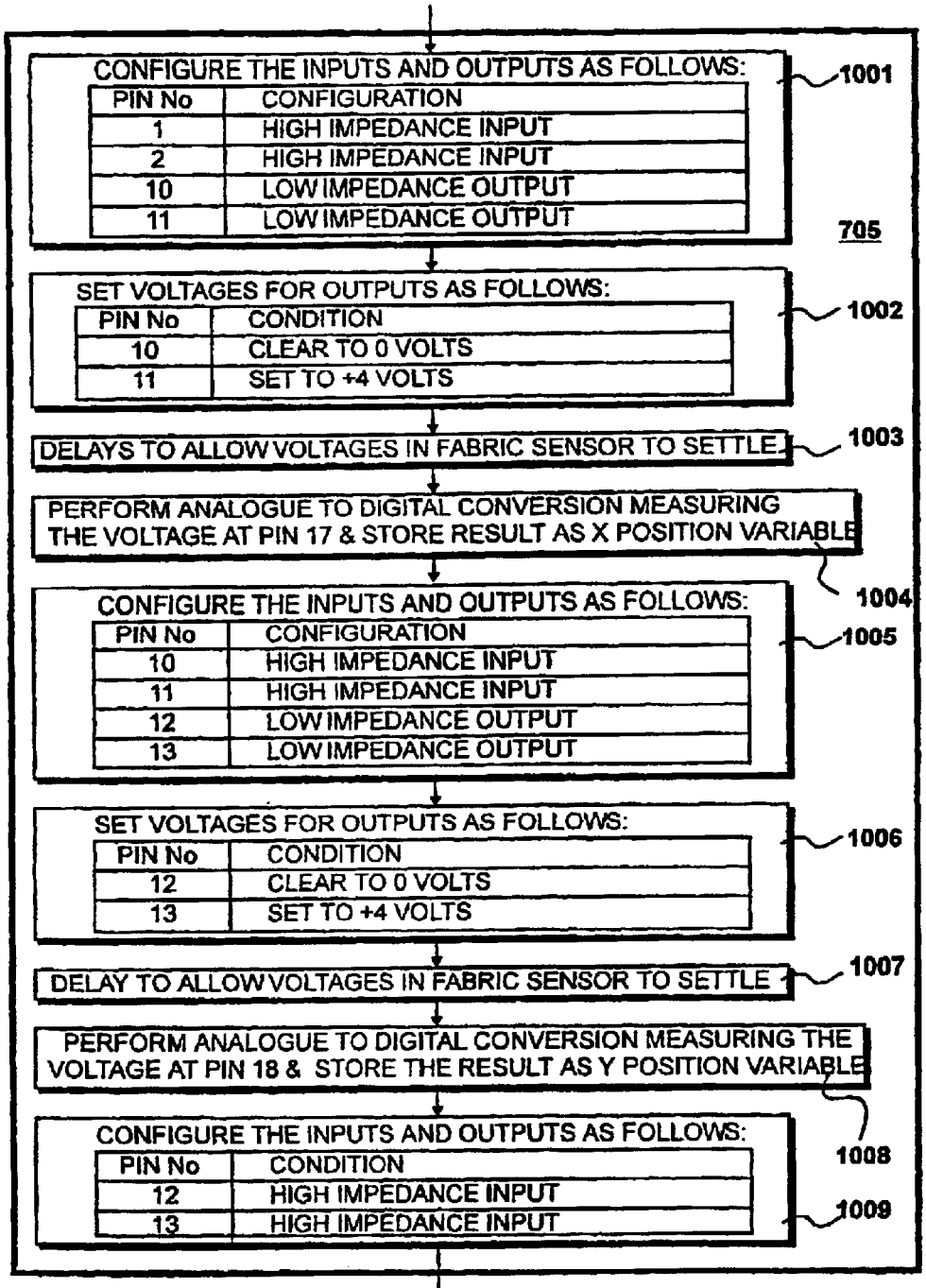
FIG. 10 shows step 705 of FIG. 7 in further detail.

Step 705 of FIG. 7 is shown in further detail in FIG. 10. Within step 705, at step 1001 pins one and two are reconfigured as high impedance inputs and pins ten and eleven as low impedance outputs. At step 1002 pin ten is set to zero volts and pin eleven is set to positive four volts. Thus, four volts are supplied to connector 505 while connector 504 is grounded. A delay is then provided at step 1003, (of typically 200 microseconds for a sensor measuring 90 mm by 240 mm) to allow voltages in the sensor to settle before the voltage on pin seventeen is measured at step 1004. Therefore a voltage V3 present on connector 507 is measured which provides an indication of the X position of the applied force. The measured value is stored as X1.

Pins ten and eleven are then reconfigured as high impedance inputs and pins twelve and thirteen are reconfigured as low impedance outputs at step 1005. The voltage on pin twelve is then set to zero while the voltage on pin thirteen is set to four volts at step 1006. Thus, four volts are supplied to connector 507 while connector 506 is grounded. A time delay is provided at step 1007, similar to that at step 1003, before the voltage appearing at pin eighteen is measured at step 1008. Thus, a voltage V4 present on connector 505 is measured which provides an indication of the Y position of the applied force, and stored as temporary variable Y1. Pins twelve and thirteen are then reconfigured back to their initial state of high impedance inputs at step 1009.

FIG. 11

Figure 11:
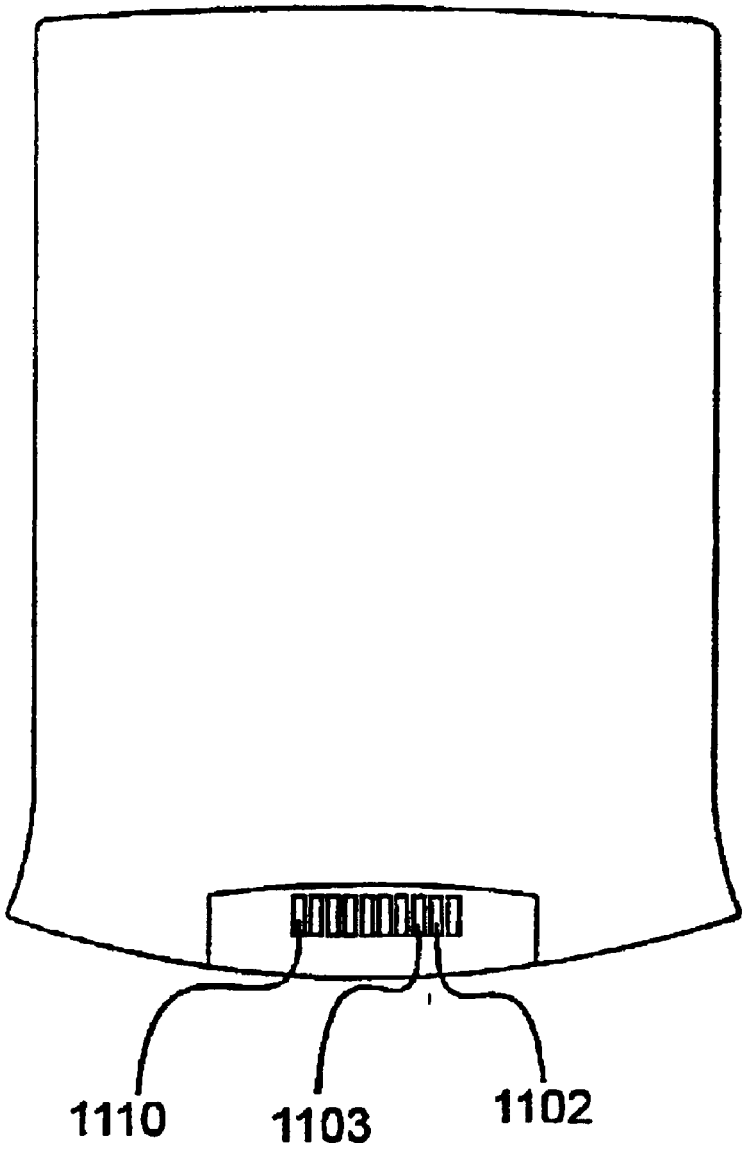
FIG. 11 shows a rear view of the computer 101.

A rear view of Palm 101 is shown in FIG. 11. The rear of the computer 101 includes ten electrical connections referred to as pins, such as pins 1102, 1103 and 1110. Pin 1102 provides approximately four volts to the interface circuit through a 330 Ohm resistor within the computer 101. From the computer's perspective, pin 1103 is the receive data connection, therefore data from interface circuit 501 is supplied to this pin. Signal ground is provided by pin 1110 and for this particular application the remaining pins are not used.

FIG. 12

Figure 12:
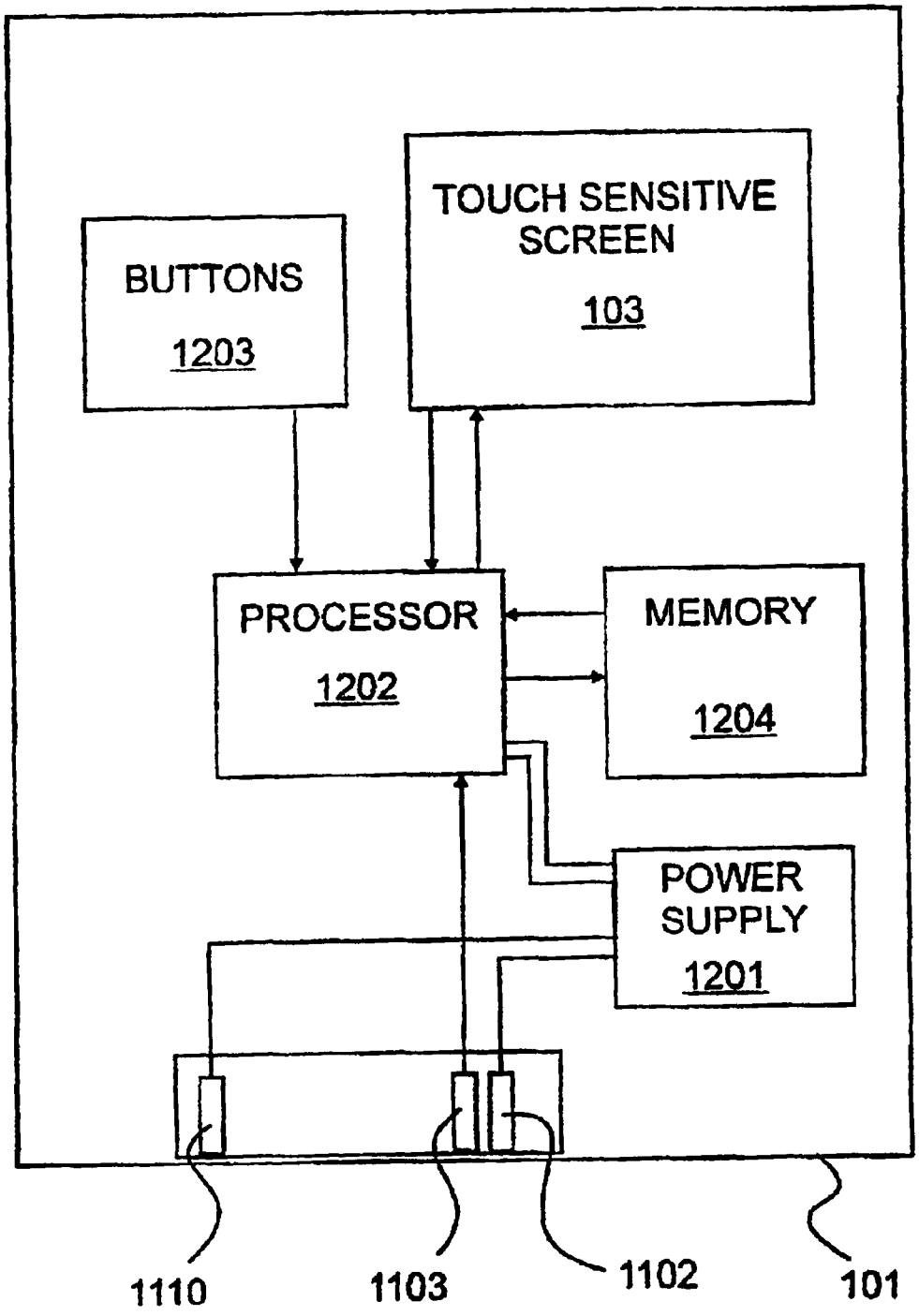
FIG. 12 shows a schematic view of computer 101.

A schematic view of computer 101 is shown in FIG. 12. The computer includes a power supply 1201 comprising rechargeable batteries. The batteries conventionally supply electrical power to various components of the computer, but in this embodiment they also supply power to the interface circuit 501 through the computer's pins 1102 and 1110 as mentioned above. The computer further comprises a processor 1202 which is in communication with the computer's touch sensitive display 103, the computer's hardware buttons 1203 and memory 1204. Amongst other functions, the processor 1202 runs the keyboard application program resident in the memory 1204, which was downloaded in a "Hotsync" process as previously described. When running the keyboard application, the processor receives data sent by the interface circuit 501 via pin 1103 and processes the received data to generate display data representing characters such as letters and numbers, which it then stores in a keyboard buffer for display on the LCD display 103.

FIG. 13

Figure 13:
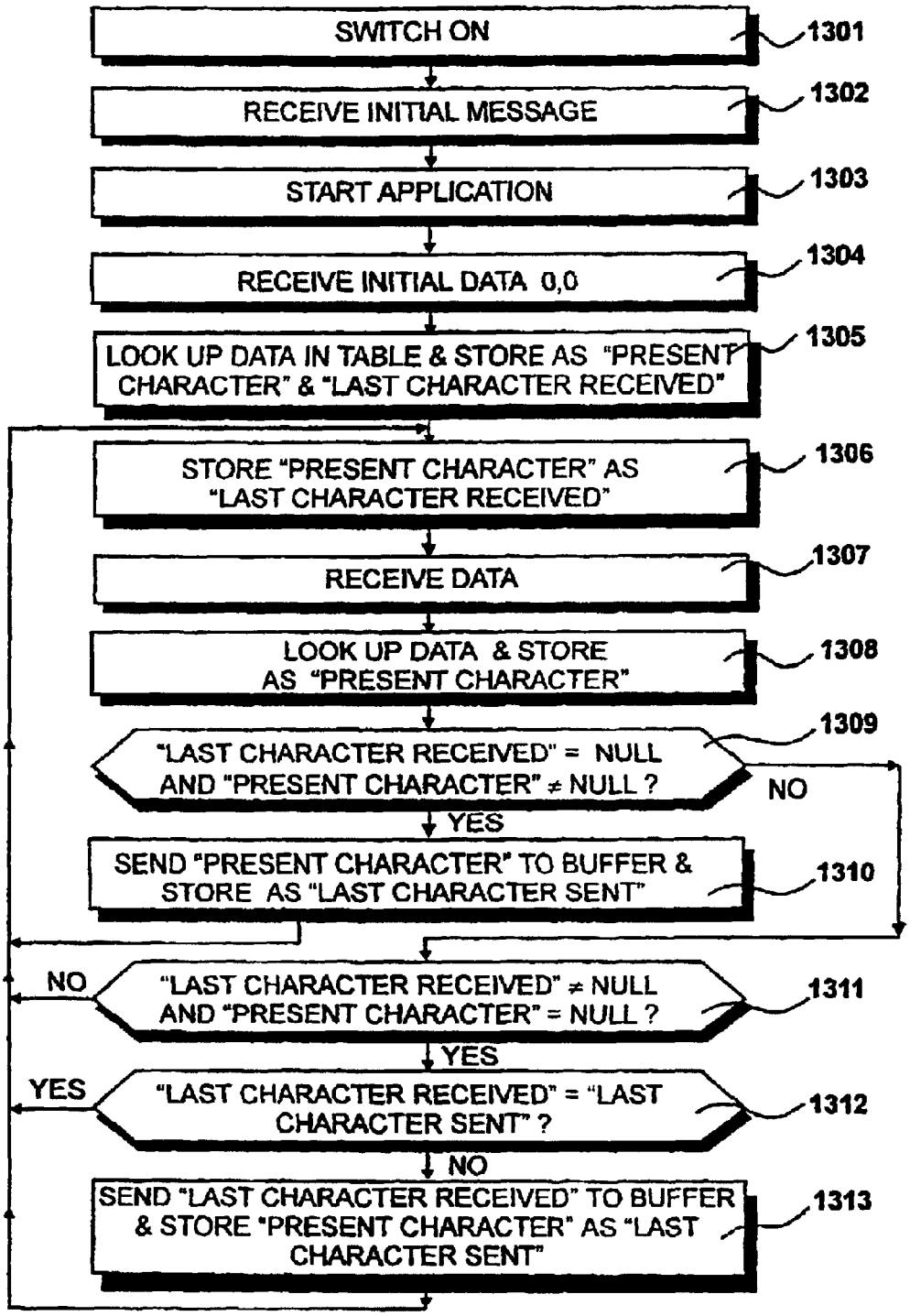
FIG. 13 shows a flow chart illustrating the keyboard application program running in the computer 101.

The keyboard application program running in the computer 101 is illustrated by the flow chart of FIG. 13. Following the computer being switched on at step 1301 it receives the initial message sent by the PIC 502, as identified at step 805 on FIG. 8. At step 1302 the computer 101 receives the initial message, then at step 1303 the computer's operating system starts the keyboard application. At step 1304 the initial data 0,0 sent by the PIC, as identified at step 805, is received and at step 1305 the received data is looked up in a table where corresponding character data, is retrieved and stored as both temporary variables "present character" and "last character sent". Where the received data relates to the position of an interaction with the keyboard, i.e. a key-press, the character data retrievable from the look up table corresponds to data recognised by the computer to display characters such as letters, numbers and brackets or perform typing functions such as "shift", "backspace", "control", "return", etc. However, in this instance, the received data is 0,0, and so the data retrieved from the table corresponds to the null character, rather than a display related character.

At step 1306 data stored as "present character" is stored as the temporary variable "last character received". So, in the first instance of entering step 1306, the null character is stored as "last character received", and, as always, the value of "last character received" relates to the last data received from the PIC.

At step 1307 the processor waits to receive more data from the interface circuit before entering step 1308 where the newly received data is looked up in the look up table, and new character data is retrieved and stored as "present character". At step 1309, a question is asked as to whether "last character received" is the null character and "present character" is not the null character. If the question is answered yes, as it will be in the first instance of a key-press, step 1310 is entered where the data stored as "present character" is sent to the keyboard buffer for display purposes. In addition, the data stored as "present character" is stored as "last character sent". Thus, the last character sent to the keyboard buffer is recorded.

The process then re-enters 1306 where the data stored as "present character" is also stored as "last character received". The processor then waits for the receipt of further data at step 1307 before repeating steps 1308 and 1309.

The second time step 1309 is entered is an example of when the question will be answered in the negative, since the "last character received" is no longer the null character. If the question at step 1309 is answered "no" then step 1311 is entered where a question is asked as to whether "last character received" is not the null character and "present character" is the null character. If this question is answered negatively, the process returns to step 1306 and steps 1306 to 1309 are repeated. This would occur if both "last character received" and "present character" correspond to positional data received from the PIC, as would happen during the aforementioned overlapping key-presses.

If the question asked at step 1311 is answered in the affirmative, then step 1312 is entered. This situation corresponds to the release of a key leaving the keyboard with no keys pressed. Said released key could have been an individually pressed key or the second of two keys in an overlapping key-press. At step 1312 a further question is asked as to whether "last character received" is the same as "last character sent". In the case of a single key being individually pressed and released, the answer to this question will be "yes", and the process returns to step 1306. However, in the case of an overlapping key-press the answer to this question will be "no", resulting in "last character received" being sent to the keyboard buffer at step 1313, and "present character" being stored as "last character sent". The process then returns to 1306.

By this process, the computer's processor is able to receive data relating to individual key-presses and generate data corresponding to a single character. It is also able to receive data relating to two overlapping key-presses and generate data for the corresponding two characters.

In the above described embodiment the processing of the signals received from the keyboard sensor, i.e. from the conducting layer 301 and 302, is performed by the PIC and further by the processor located within the computer. However, in an alternative embodiment, the process described with respect to FIG. 13 is performed by the PIC in interface circuit 501, along with the process of FIG. 7. Thus, the computer is supplied with data which it recognises as originating from a keyboard and corresponding to characters for display on its LCD 103. The processing workload of the computer may thus be reduced. This embodiment is more appropriate where the processing power of the computer is more limited.

In another alternative embodiment, a similar process to that described with respect to FIG. 13 is performed by the PIC in interface circuit 501, along with the process of FIG. 7. However, in this embodiment the keyboard 102 is connected to a serial input port of a mobile phone and the PIC is configured to send AT commands to the phone in response to key-presses. By this means, a user is able to enter text to the phone for, for example, Short Message Service (SMS) messages.

FIG. 14

Figure 14:
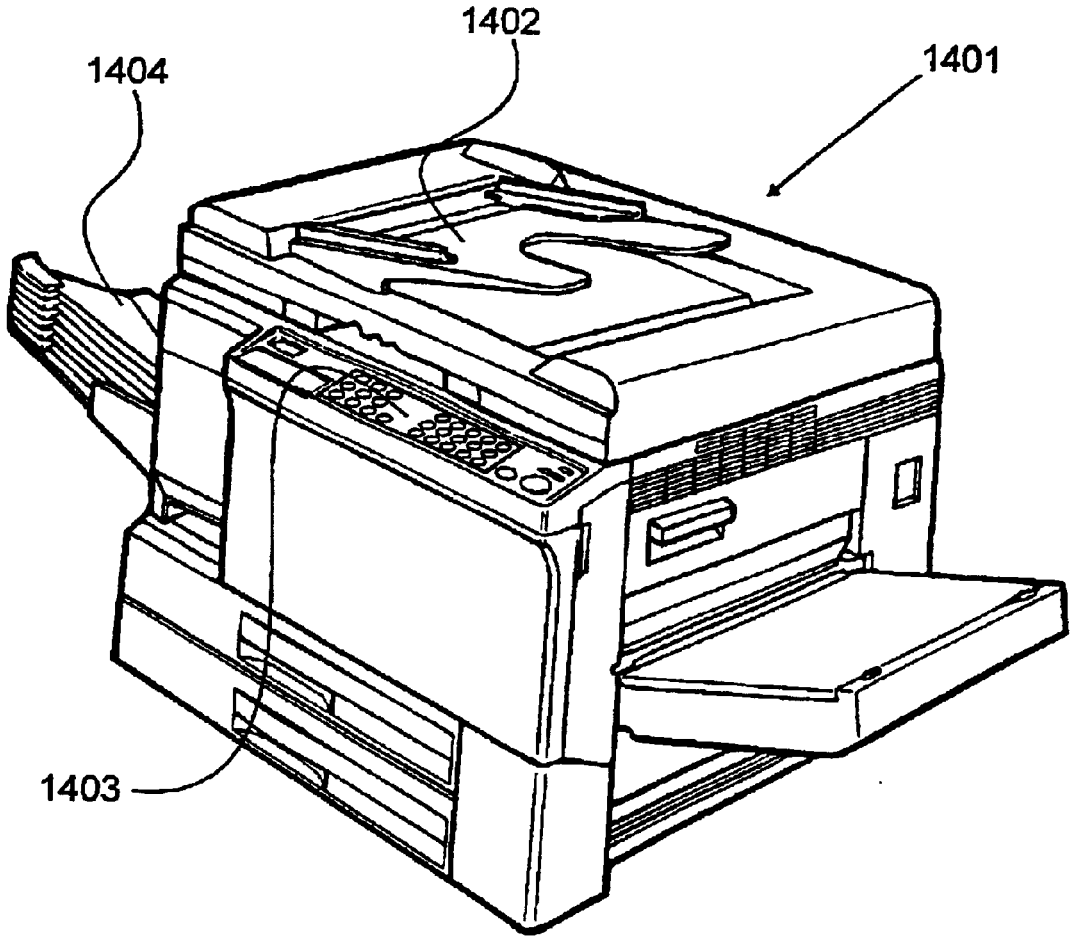
FIG. 14 shows a photocopier 1401 providing an alternative embodiment of the present invention.

A photocopier 1401 providing a further alternative embodiment of the present invention is shown in FIG. 14. The photocopier is arranged to receive original documents via feeder 1402, and under manual instructions input at touch screen 1403, produce photocopies which are delivered at collating trays 1404. The rectangular touch screen 1403 displays an array of keys representing numerals and a variety of functions. Thus, for example, a user may select the number of copies for print by pressing the corresponding number keys, and select paper size, enlargement ratio, collating requirements etc. by pressing the function key followed by number keys where necessary. The touch screen therefore provides a replacement for a conventional keyboard with hardware buttons or keys.

FIG. 15

Figure 15:
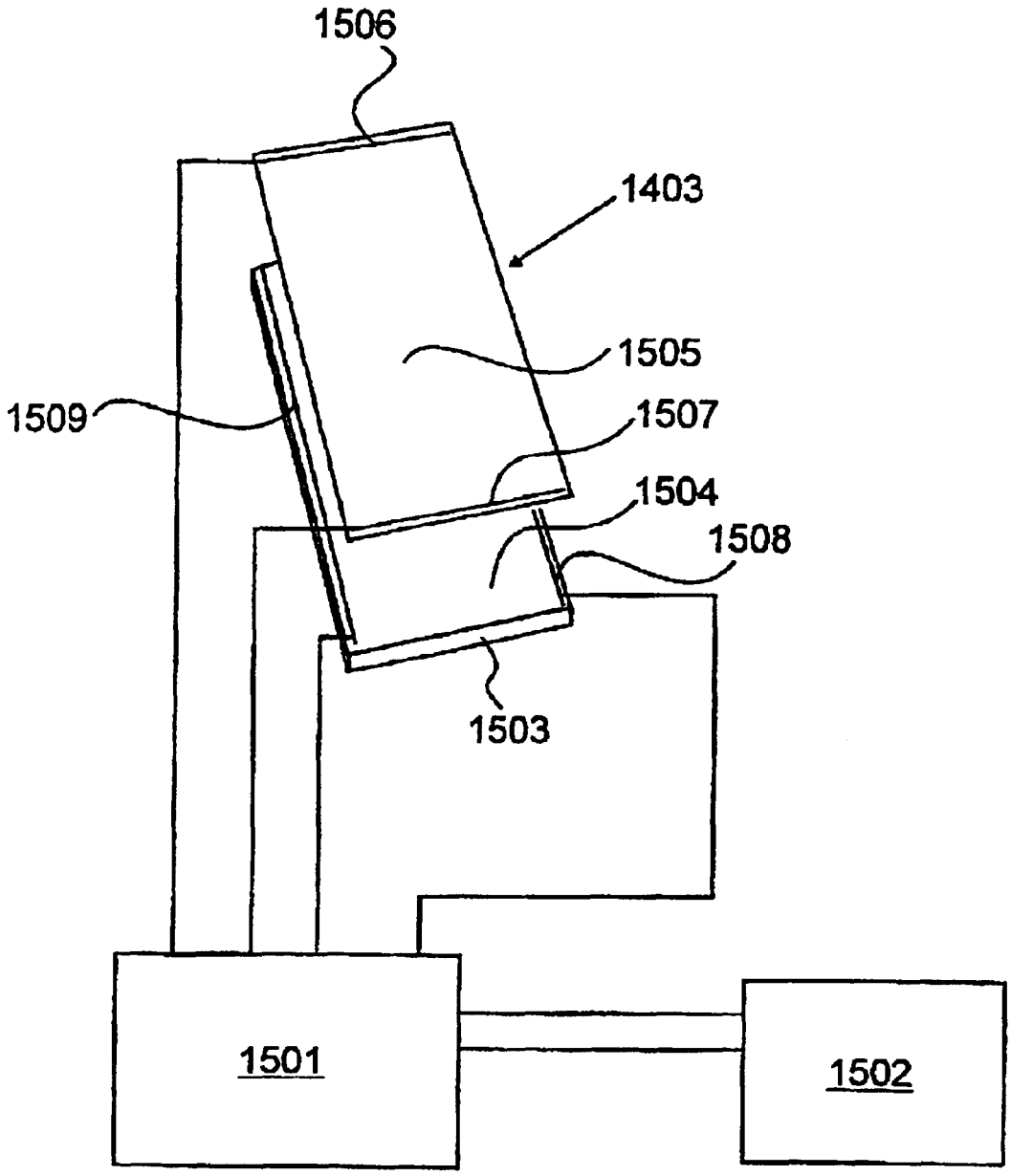
FIG. 15 shows schematically a touch sensitive screen 1403 and a micro-controller 1501 located in the photocopier 1401.

The touch sensitive screen 1403 and a micro-controller 1501 located in the photocopier 1401 are shown schematically in FIG. 15. The micro-controller 1501 is in communication with a memory device 1502, along with various transducers (not shown) located within the photocopier and necessary for its operation.

The touch sensitive screen 1403 includes a liquid crystal display 1503 which has a glass sheet 1504 as its uppermost layer. The glass sheet 1504 has an electrically conductive transparent coating applied to its upper surface. This is then held parallel to a transparent plastic sheet 1505 having an electrically conductive transparent coating on its lower surface. The two sheets 1504 and 1505 are held very close together and a small mechanical pressure, such as produced by a user's finger applied to upper sheet 1505, results in electrical contact being made between the two sheets. The plastic sheet 1505 has highly conductive tracks 1506 and 1507 located along its two shorter opposing edges and in contact with the conductive coating. These conductive tracks 1506 and 1507 are connected to input/output ports of the controller 1501. Thus, the controller is able to apply a voltage across the conductive layer on the upper sheet. In a similar manner a pair of highly conductive tracks 1508 and 1509 are located on the lower conductive coating adjacent to the opposing longer edges of the sheet 1504. These tracks 1508 and 1509 are also connected to input/output ports of the micro-controller.

The memory device 1502 contains operating instructions which the micro-controller accesses and executes. Amongst other things, the operating instructions include those for supplying voltages to the touch screen's conducting tracks 1506 to 1509 and for processing signals received from said tracks. Operating under said instructions the processor performs processes analogous to those described with reference to FIGS. 7 to 10 and 13, and hence is able to interpret signals received from the touch sensitive screen 1403 as key-presses of a keyboard. In particular, it is able to receive signals produced from overlapping key-presses and generate data corresponding to two typed characters.

In an alternative embodiment, the photocopier includes a second controller which performs the functions carried out by the PIC 501 in the first embodiment. Thus, the two controllers in the photocopier co-operate in a similar manner to the PIC 501 and processor 1202.

Like the first described embodiment, only four connections are possible to the touch sensor of the photocopier 1401, two connections to conductive tracks 1506 and 1507 of layer 1505, and two connections to conductive tracks 1508 and 1509 of layer 1504.

In a further alternative embodiment, a personal computer (PC) is connected to a monitor with a capacitive touch sensitive screen. An example of a suitable touch sensitive monitor is presently supplied by Farnell Electronic Components Limited, of Leeds, U.K, as a 15" XGA Capacitive Touch monitor, LMU-TK15AT. The touch sensitive monitor provides serial data to the PC, comprising XY positional data relating to where it is being touched and other data identifying the absence of a touch. Application software allowing the PC to receive and interpret the signals from the touch sensitive device are installed on its hard drive.

When the touch sensitive device is used, the PC's processor runs the application software which performs a similar process to that detailed earlier in respect of FIG. 13. Thus, for example, it is possible for the PC to display an array of buttons on the touch sensitive screen of its monitor and the application software allows a user to select a button by touching the screen at the correct position. Moreover, the PC is able to correctly identify two pressed keys when the user makes overlapping "key-presses" to the touch sensitive screen in the manner previously described.

It may be seen from the above embodiments, that the process for generating characters from overlapping key-presses is applicable to many alternative data processing apparatuses, where positional data is derived from a single positional sensor, which is used to simulate actions of a keyboard. Furthermore, many types of sensor, such as fabric and non-fabric resistive touch sensors, and capacitive touch sensors, are capable of supplying the data required by the data processing apparatus.

What is claimed is:

1. Data processing apparatus configured to generate data representing displayable characters in response to receiving signals from an input sensor, said signals corresponding to positions of mechanical interactions with said sensor, said apparatus comprising:

processing means configured to process data derived from said signals from said input sensor including data of a first type corresponding to the position of a mechanical interaction with said input sensor and data of a second type corresponding to the absence of a mechanical interaction with said input sensor, wherein when mechanical interactions at different positions with said input sensor overlap in time said processing means is configured to generate data representing a first character in response to processing an item of data of said second type followed by data of said first type corresponding to the position of a first mechanical interaction with said input sensor, and to generate data representing a different second character in response to processing an item of data of said second type following data of said first type corresponding to the position of a second different mechanical interaction with said input sensor.

2. Data processing apparatus according to claim 1, wherein said input sensor comprises a first conducting layer and a second conducting layer, each of said conducting layers having a conductive track positioned along opposing edges, and said data processing apparatus is configured to apply a voltage between said conductive tracks of said first layer and to measure the voltage appearing at a conductive track of said second layer to determine data of said first type.

3. Data processing apparatus according to claim 1, wherein said processing means is configured to:

(a) perform a first measurement relating to the position of a mechanical interaction with said sensor to generate a first measurement value;

(b) perform a second measurement relating to the position of said mechanical interaction to generate a second value; and (c) generate said data of said first type only when said first value is within a predetermined amount of said second value.

4. Data processing apparatus according to claim 1, wherein said sensor is an XY position sensor, and said data of said first type corresponds to the position within a continuous area defined by said sensor.

5. Data processing apparatus according to claim 1, wherein said processing means is configured to measure a parameter of said sensor relating to the pressure applied to said sensor.

6. Data processing apparatus according to claim 5, wherein said data of said first type is generated by said processing means only when said measured parameter exceeds a predetermined amount.

7. Data processing apparatus according to claim 1, wherein said data processing apparatus comprises a hand-held computer.

8. Data processing apparatus according to claim 1, wherein said processing means comprises two processing devices, such that:

one of said processing devices is configured to receive said signals from said input sensor and to generate said positional data and data of said second data type; and the second of said processing devices is configured to process said data of said first type and said data of said second type to generate data corresponding to displayable characters.

9. Data processing apparatus according to claim 8, wherein second processing device is located in a computer.

10. Data processing apparatus according to claim 8, wherein said first processing device forms part of a keyboard assembly.

11. Data processing apparatus according to claim 8, wherein said first processing device is configured to generate a stream of data comprising data of said first type, and to send positional data to said second processing device only when an item of data of said first type differs from the immediately preceding item of sent data by more than a predetermined amount.

12. Data processing apparatus according to claim 1, wherein said input sensor forms part of said data processing apparatus, and said input sensor comprises at least two layers of conductive fabric.

13. A method of processing signals received from an input sensor, said signals corresponding to positions of mechanical interactions with said sensor, wherein said method comprises:

processing data derived from said signals, said data comprising data of a first type corresponding to the position of a mechanical interaction with said input sensor and data of a second type corresponding to the absence of a mechanical interaction with said input sensor, such that when mechanical interactions at different positions with said input sensor overlap in time data representing a first character is generated in response to processing an item of data of said second type followed by an item of data of said first type corresponding to the position of a first mechanical interaction with said input sensor, and data representing a different second character is generated in response to processing an item of data of said second type following an item of data of said first type corresponding to the position of a second different mechanical interaction with said input sensor.

14. A method of processing signals according to claim 13, wherein said input sensor comprises a first conducting layer and a second conducting layer, each of said conducting Layers having a conductive track positioned along opposing edges, and said data processing apparatus is configured to apply a voltage between said conductive tracks of said first layer and to measure the voltage appearing at a conductive track of said second layer to determine said data of said first type.

15. A method of processing signals according to claim 13, wherein said method includes the steps of:

(a) performing a first measurement relating to the position of a mechanical interaction with said sensor to generate a first measurement value;

(b) performing a second measurement relating to the position of said mechanical interaction to generate a second value; and (c) generating data of said first type only when said first value is within a predetermined amount of said second value.

16. A method of processing signals received from an input sensor according to claim 13, wherein said sensor is an XY position sensor, and said data of said first type corresponds to the position within a continuous area defined by said sensor.

17. A method of processing signals received from an input sensor according to claim 13, wherein a parameter of said sensor relating to the pressure applied to said sensor is measured, and said data of said first type is generated by only when said parameter exceeds a predetermined threshold value.

18. A method of processing signals received from an input sensor according to claim 13, wherein a stream of data comprising data of first said type is generated, and an item of positional data of said first type is processed to generate data representing a character only when said item of positional data of said first type differs from the immediately preceding item of data in said stream by more than a predetermined amount.

19. Data processing apparatus configured to generate data representing displayable characters in response to receiving signals from an input sensor, said signals corresponding to positions of mechanical interactions with said sensor, said apparatus comprising:

a processor configured to process data derived from said signals received from said input sensor, said data comprising data of a first type corresponding to the center of the position of a mechanical interaction with said input sensor and data of a second type corresponding to the absence of a mechanical interaction with said input sensor, wherein when mechanical interactions at different positions with said input sensor overlap in time said processor is configured to generate character data representing a first character in response to processing an item of data of said second type followed by data of said first type corresponding to the center of the position of a first mechanical interaction, and to generate character data representing a different second character in response to processing an item of data of said second type following data of a first type corresponding to the center of the position of a second different mechanical interaction.

20. Data processing apparatus according to claim 19, wherein said data processing apparatus comprises a second processor configured to generate said data of said first type and said data of said second type in response to said signals received from said input sensor.

* * * * *